US007182153B2

(12) United States Patent
Moriarty

(10) Patent No.: US 7,182,153 B2
(45) **Date of Patent: *Feb. 27, 2007**

(54) METHODS OF CASING DRILLING

(75) Inventor: Keith Alan Moriarty, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 83 days.

This patent is subject to a terminal disclaimer.

(21) Appl. No.: 10/754,302

(22) Filed: Jan. 9, 2004

(65) Prior Publication Data

US 2005/0150690 A1 Jul. 14, 2005

(51) Int. Cl.
*E21B 7/04* (2006.01)

(52) U.S. Cl. ..... 175/61; 175/73; 175/171

(58) Field of Classification Search ..... 175/61, 175/62, 73, 75, 171
See application file for complete search history.

(56) References Cited

U.S. PATENT DOCUMENTS

| | | | | |
|---|---|---|---|---|
| 4,842,081 | A | 6/1989 | Parant | |
| 5,082,069 | A | 1/1992 | Seilor et al. | |
| 5,117,927 | A | 6/1992 | Askew | |
| 5,197,553 | A | 3/1993 | Leturno | |
| 5,219,028 | A | 6/1993 | Martin et al. | |
| 5,255,741 | A | 10/1993 | Alexander | |
| 5,452,967 | A | 9/1995 | Fuller | |
| 5,456,326 | A | 10/1995 | Raines | |
| 5,472,057 | A | 12/1995 | Winfree | |
| 5,662,170 | A | 9/1997 | Donovan et al. | |
| 5,755,289 | A | 5/1998 | Angman et al. | |
| 5,839,519 | A | 11/1998 | Spedale, Jr. | |
| 5,845,722 | A | 12/1998 | Makohl et al. | |
| 5,921,332 | A | 7/1999 | Spedale, Jr. | |
| 5,950,742 | A | 9/1999 | Caraway | |
| 5,957,225 | A | 9/1999 | Sinor | |
| 6,102,119 | A | 8/2000 | Raines | |
| 6,158,531 | A | 12/2000 | Vail, III | |
| 6,182,776 | B1 | 2/2001 | Asberg | |
| 6,196,336 | B1 | 3/2001 | Fincher et al. | |
| 6,199,641 | B1 | 3/2001 | Downie et al. | |
| 6,227,306 | B1 | 5/2001 | Downie et al. | |
| 6,263,987 | B1 | 7/2001 | Vail, III | |
| 6,311,792 | B1 | 11/2001 | Scott et al. | |
| 6,419,033 | B1 * | 7/2002 | Hahn et al. | 175/61 |
| 6,877,570 | B2 * | 4/2005 | Chen et al. | 175/22 |
| 2002/0040787 | A1 | 4/2002 | Cook et al. | |
| 2002/0050360 | A1 | 5/2002 | Cook et al. | |
| 2002/0175003 | A1 | 11/2002 | Pisoni et al. | |
| 2002/0179336 | A1 | 12/2002 | Schaaf et al. | |
| 2004/0140128 | A1 * | 7/2004 | Vail | 175/57 |
| 2005/0126826 | A1 * | 6/2005 | Moriarty et al. | 175/61 |

FOREIGN PATENT DOCUMENTS

| | | |
|---|---|---|
| EP | 0462618 A2 | 12/1991 |

(Continued)

*Primary Examiner*—William Neuder
(74) *Attorney, Agent, or Firm*—Mathias Abrell; Brigette L. Echols; Dale Gaudier

(57) ABSTRACT

The present invention provides a method and apparatus for casing while drilling without the use of an underreamer. In one aspect, the invention provides a flexible drill collar that enables drilling of a large enough borehole for passage of the casing string therethrough.

24 Claims, 5 Drawing Sheets

FOREIGN PATENT DOCUMENTS

| | | | |
|---|---|---|---|
| WO | WO00/37771 | | 6/2000 |
| WO | WO00/50730 | | 8/2000 |
| WO | WO01/83932 | A1 | 11/2001 |
| WO | WO01/86111 | A1 | 11/2001 |
| WO | WO01/94738 | A1 | 12/2001 |
| WO | WO01/94739 | A1 | 12/2001 |
| WO | WO02/10549 | A2 | 2/2002 |
| WO | WO02/14649 | A1 | 2/2002 |

* cited by examiner

METHODS OF CASING DRILLING

BACKGROUND OF INVENTION

Wells are generally drilled into the ground to recover natural deposits of hydrocarbons and other desirable materials trapped in geological formations in the Earth's crust. A well is typically drilled using a drill bit attached to the lower end of a "drill string." The drill string is a long string of sections of drill pipe that are connected together end-to-end. Drilling fluid, or mud, is typically pumped down through the drill string to the drill bit. The drilling fluid lubricates and cools the drill bit, and it carries drill cuttings back to the surface in the annulus between the drill string and the borehole wall.

In conventional drilling, a well is drilled to a selected depth, and then the wellbore is typically lined with a larger-diameter pipe, usually called casing. Casing typically consists of casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the well from collapse and isolates the subterranean formations from each other.

Conventional drilling typically includes a series of drilling, tripping, casing and cementing, and then drilling again to deepen the borehole. This process is very time consuming and costly. Additionally, other problems are often encountered when tripping the drill string. For example, the drill string may get caught up or stuck in the borehole while it is being removed. These problems require additional time and expense to correct.

FIG. 1A shows a prior art drilling operation. A drilling rig 2 and rotary table 4 at the surface are used to rotate a drill string 6 with a drill bit 8 disposed at the lower end of the drill string 6. The drill bit 8 drills a borehole 10 through subterranean formations that may contain oil and gas deposits. Typically, an MWD (measurement while drilling) or LWD (logging while drilling) collar 12 is positioned just above the drill bit 8 to take measurements relating to the properties of the formation as the borehole 10 is being drilled. In this description, MWD is used to refer either an MWD system or an LWD system. Those having ordinary skill in the art will realize that there are differences between these two types of systems, but the differences are not germane to the embodiments of the invention.

The term "casing drilling" refers to using a casing string as a drill string when drilling. A bottom hole assembly ("BHA"), including a drill bit, is connected to the lower end of a casing string, and the well is drilled using the casing string to transmit drilling fluid, as well as axial and rotational forces, to the drill bit. Casing drilling enables the well to be simultaneously drilled and cased.

FIG. 1B shows a prior art casing drilling operation. A rotary table 14 at the surface is used to rotate a casing string 16 that is being used as a drill string. The casing 16 extends downwardly into borehole 18. A drill bit 20 is connected to the lower end of the casing string 16. When drilling with casing, the drill bit 20 must be able to pass though the casing string 16 so that the drill bit 20 may be retrieved when drilling has been completed or when replacement or maintenance of the drill bit 20 is required. Thus, the drill bit 20 is sized smaller than the inner diameter of the casing string 16.

The drill bit 20 drills a pilot hole 22 that must be enlarged so that the casing string 16 will be able to pass through the borehole 18. An underreamer 24 is positioned below the casing string 16 and above the drill bit 20 so as to enlarge the pilot hole 22. A typical underreamer 24 can be positioned in an extended and a retracted position. In the extended position, the underreamer 24 enlarges the pilot hole 22 to the underreamed borehole 18, and in the retracted position (not shown), the underreamer 24 collapses so that it is able to pass through the inside of the casing string 16.

FIG. 1B also shows an MWD collar 26 positioned above the drill bit 20 and the underreamer 24, but below the casing string 16. The MWD collar 26 takes measurements related to formation properties as drilling is taking place. It should be noted that other positions of these BHA components are possible and are not limited to the figures shown.

Casing drilling eliminates the need to trip the drill string before the well is cased. The drill bit may simply be retrieved by pulling it up through the casing. The casing may then be cemented in place, and then drilling may continue. This reduces the time required to retrieve the BHA and eliminates the need to subsequently run casing into the well.

SUMMARY OF INVENTION

One embodiment of the present invention provides an apparatus to install a casing string into a borehole while it is being drilled. The apparatus generally comprises a casing latch, a flexible drill collar, and a drill bit. The casing latch is installed at the distal end of the casing string. The casing latch has a pass-through diameter smaller than the casing internal diameter. The casing latch is releaseably connected to the flexible drill collar assembly. The flexible drill collar assembly has an enlargement tool and an articulated joint. The articulated joint enables the enlargement tool to be positioned both axially and eccentrically with respect to the axis of rotation of the casing string. The drill bit is coupled to the enlargement tool such that when the enlargement tool is in its eccentric position, the drill bit drills a borehole large enough to provide clearance for the casing string and when the enlargement tool is in its axial position, the drill bit is removable through the casing string.

Another embodiment of the present invention provides a method of casing while drilling without the use of an underreamer. The method comprises providing a flexible drill collar assembly coupled to the casing string. The flexible drill collar has an enlargement tool affixed to a drill bit and positionable axially and eccentrically with respect to the axis of rotation of the casing string. The method further comprises positioning the enlargement tool eccentrically such that the affixed drill bit drills a borehole large enough for passage of the casing string therethrough.

Another embodiment of the present invention provides an apparatus to install a casing string into a borehole while it is being drilled. The apparatus comprises a casing latch and a vertical drilling assembly. The casing latch is installed at a distal end of the casing string and has a pass-through diameter smaller than the casing internal diameter. The casing latch is releaseably connected to the vertical drilling assembly. The vertical drilling assembly includes a mud motor, a first cutter device, and a second cutter device. The mud motor is configured to rotate the first cutter device in a direction opposite any rotation of the casing string. The second cutter device is configured to rotate with the rotation of the casing string. The vertical drilling assembly is configured to be retrieved through the pass-through diameter of the casing latch.

Another embodiment of the present invention provides an apparatus to install a casing string into a borehole while it is being drilled. The apparatus comprises a casing latch and a vertical drilling assembly. The casing latch is installed at a distal end of the casing string. The casing latch has a pass-through diameter smaller than the casing internal diameter and is configured to releaseably connect to the vertical drilling assembly. The vertical drilling assembly includes directional measurement equipment and at least one actuator. The directional measurement equipment is configured to determine any deviations of the borehole from true vertical. The actuator is configured to directionally bias the vertical drilling assembly in response to reports from the directional measurement equipment. The vertical drilling assembly is configured to be retrieved through the pass-through diameter of the casing latch.

Other aspects and advantages of the invention will be apparent from the following description and the appended claims.

DETAILED DESCRIPTION

Figure 1A:
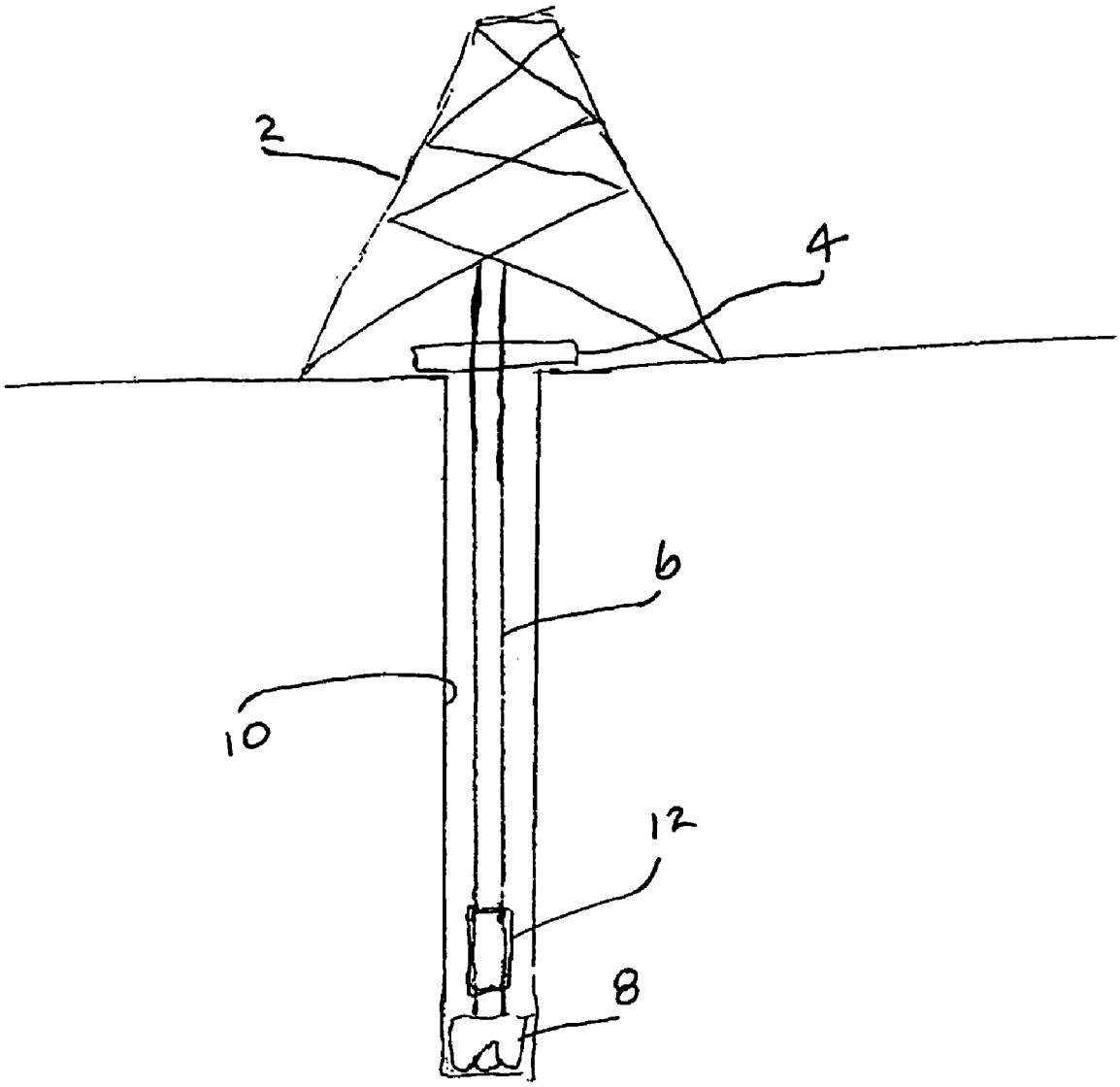
FIGURE 1A (PRIOR ART)
FIG. 1A shows a prior art drilling system.
Figure 1B:
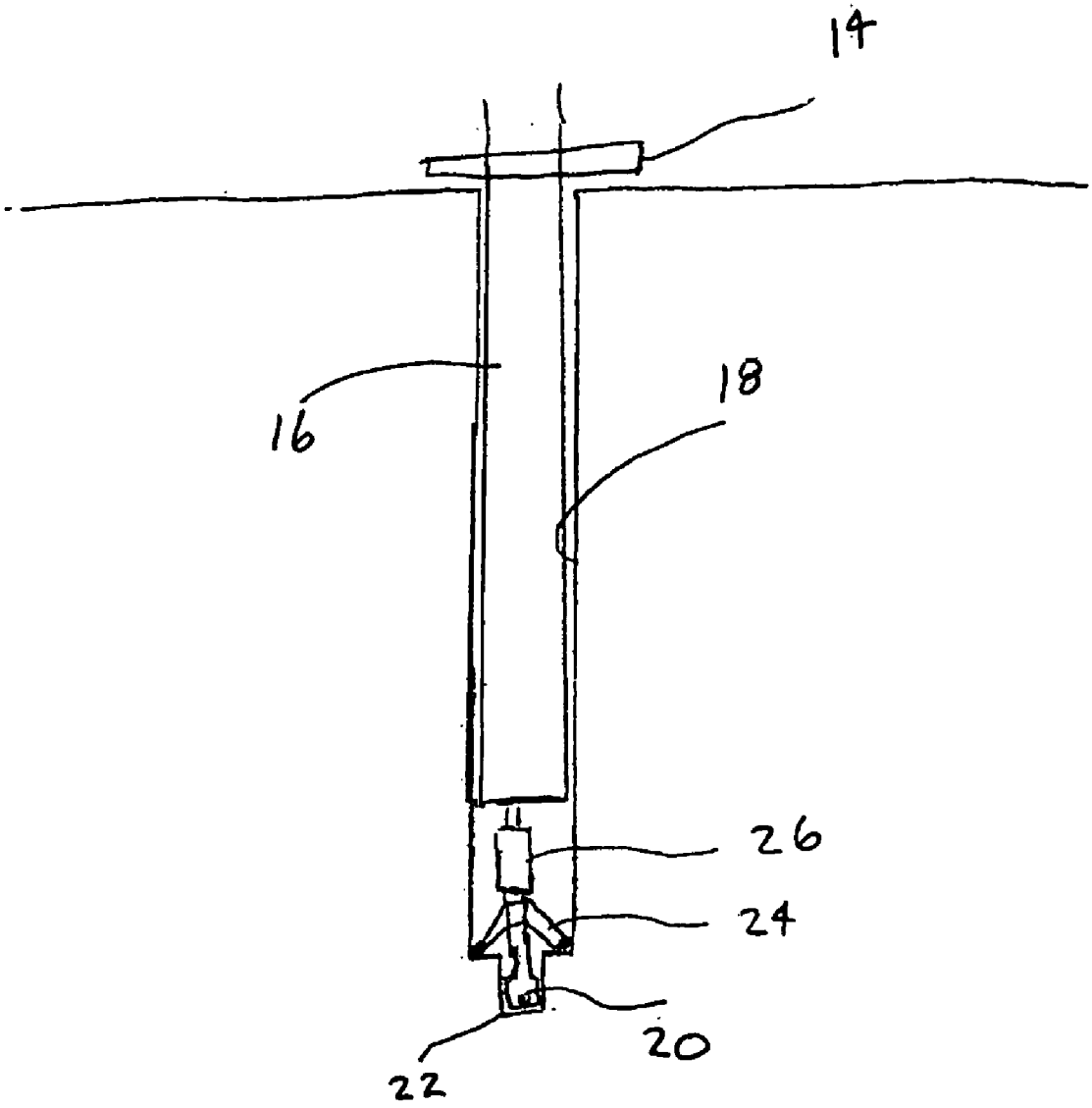
FIGURE 1B (PRIOR ART)
FIG. 1B shows a prior art casing drilling system.
Figure 2:
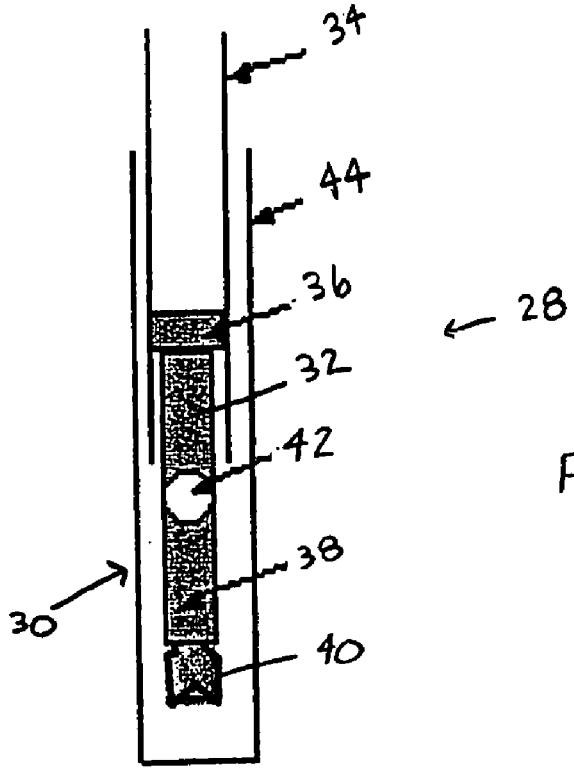
FIG. 2 shows a casing drilling system having an embodiment of the flexible drill collar of the present invention. The flexible drill collar is shown in its straight configuration.
Figure 3:
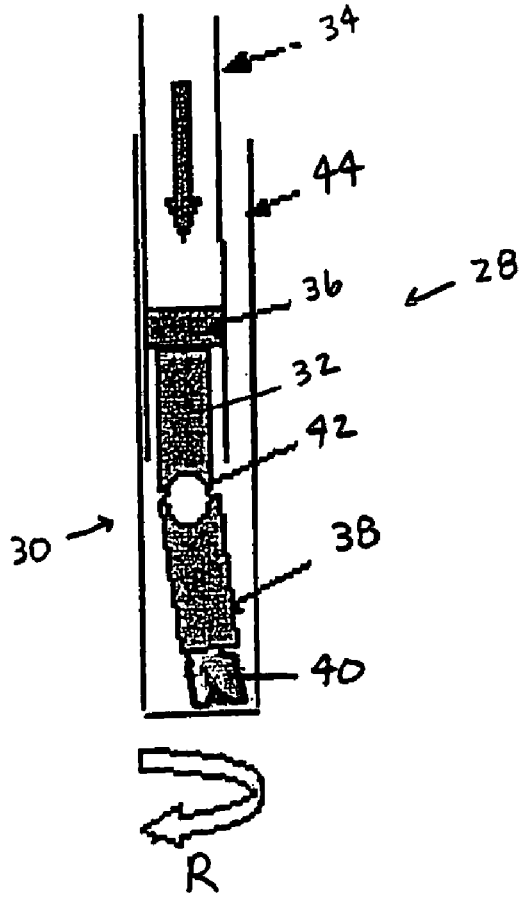
FIG. 3 shows a casing drilling system having an embodiment of the flexible drill collar of the present invention. The flexible drill collar is shown in its bent configuration.

FIGS. 2 and 3 show a casing drilling system in accordance with one embodiment of the invention. The bottom hole assembly (BHA) 28 of the illustrated casing drilling system comprises a flexible drill collar assembly 30. FIG. 2 shows an embodiment of the flexible drill collar assembly 30 in a straight (axial) configuration and FIG. 3 shows the flexible drill collar assembly 30 in a bent (eccentric) configuration.

The flexible drill collar assembly 30 of the present invention has an upper section 32 that is coupled to a distal end of the casing string 34 by a casing latch 36. The casing latch 36 can be mechanically disengaged in order to remove the flexible drill collar assembly 30 from the well through the casing string 34 as necessary for bit/BHA replacement or maintenance. The flexible drill collar assembly 30 can be removed by wire-line, coiled tubing, drill pipe or other means known in the art. The casing latch 36 provides rotational and axial coupling of the flexible drill collar assembly 30 to the casing string 34.

The flexible drill collar assembly 30 further has an enlargement tool 38. The distal end of the enlargement tool 38 is affixed to a drill bit 40 and the proximal end of the enlargement tool 38 is coupled to the upper section 32 of the flexible drill collar assembly 30 through an articulated joint 42. The articulated joint 42 enables both axial and eccentric positioning of the enlargement tool 38, and thus the drill bit 40, with respect to the axis of rotation of the casing string 34.

The flexible drill collar assembly 30 allows the drilling of a borehole 44 that is large enough for the casing string 34 to be used as the drill stem with the ability to retrieve the drill bit 40 and the BHA 28 through the casing string 34. The above is accomplished while eliminating the necessity of an underreamer.

In use, the flexible drill collar assembly 30 is run through the casing string 34 with the enlargement tool 38 in the axial position (FIG. 2). The enlargement tool 38 of the flexible drill collar assembly 30 is then positioned by the articulated joint 42 eccentrically with respect to the axis of rotation of the casing string 34 (FIG. 3). The articulated joint 42 both positions and locks the eccentric position of the enlargement tool 38. The eccentric positioning can be accomplished through either flow, weight or any other means known to one skilled in the art. The means of locking the position can be accomplished through sliding cams, eccentric tracks with cam followers, j-slot mechanisms or a variety of other devices known in the art.

Once eccentrically positioned, the enlargement tool 38, and thus drill bit 40, is rotated in direction R about the axis of casing string 34, thereby allowing creation of a larger diameter borehole 44 than the gauge size of the drill bit 40. The larger diameter borehole 44 provides clearance for the casing string 34 to pass through.

To retrieve the drill bit 40 and BHA 28, the articulated joint 42 is unlocked with the flow, weight, or other actuation means. Once the enlargement tool 38 has returned to its axial position, the BHA 28 can be removed from the wellbore 44 through the casing string 34.

Figure 4:
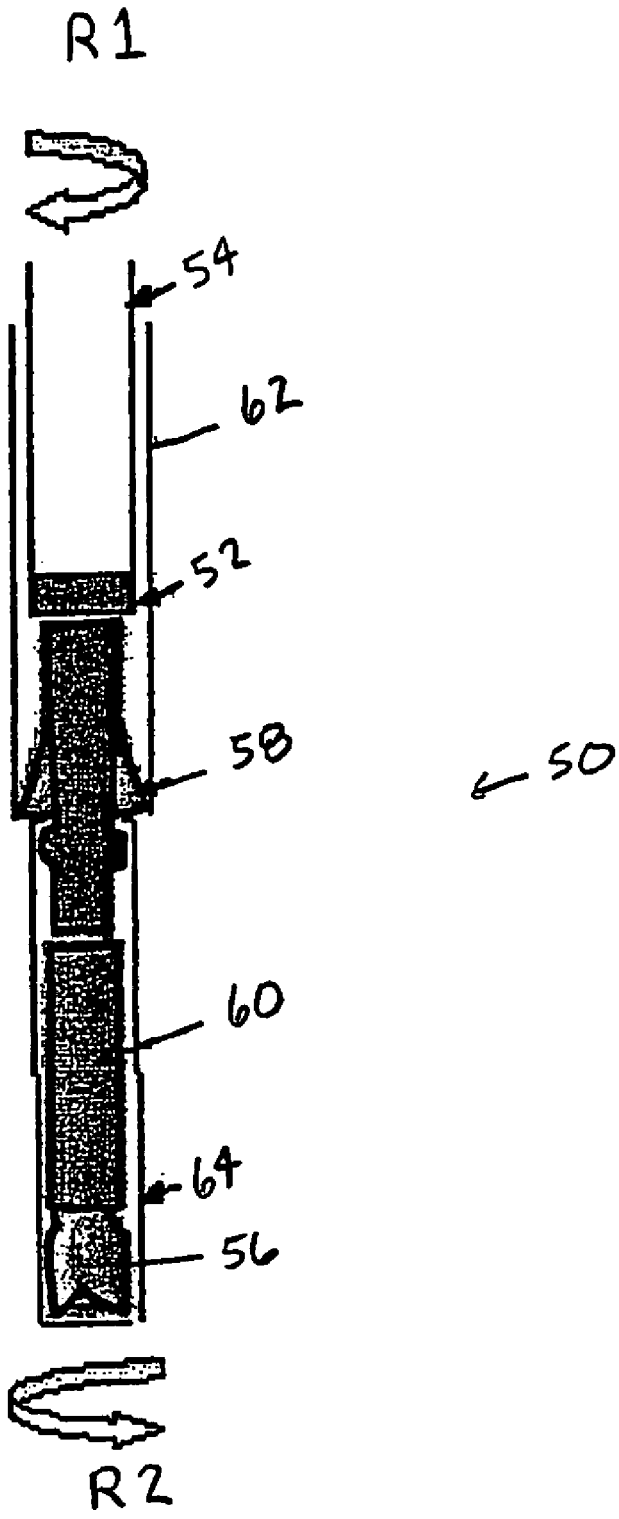
FIG. 4 shows an embodiment of the vertical drilling system of the present invention.

FIG. 4 illustrates a casing drilling system comprising an embodiment of the vertical drilling apparatus 50 of the present invention. The vertical drilling apparatus 50 is shown attached to a casing latch 52 at a distal end of a casing string 54. While the vertical drilling apparatus 50 is shown in the context of a casing drilling system, it should be understood by one of ordinary skill in the art that in alternate embodiments, a conventional drillstring may be used to deploy the vertical drilling apparatus 54 without departing from the spirit of the invention. As such a traditional drillstring would replace casing string 54 and casing latch 52 in the schematic with a long string of traditional drill pipe and drill collars.

The vertical drilling apparatus 50 shown in FIG. 4 comprises a drill bit 56, an underreamer 58 and a mud motor 60. While no particular configuration is shown for the mud motor 60, it should be understood by one of ordinary skill in the art that the mud motor 60 may be either a positive displacement type or a turbine design type.

The vertical drilling apparatus 50 is used when the rig operator desires a straight vertical borehole 62. As the vertical drilling apparatus 50 is run downhole, the casing string 54 with the attached underreamer 58 is rotated in direction R1. At the same time, the mud motor 60 is operated to rotate the drill bit 56 to cut a pilot hole 64 in direction R2. Preferably, directions R1 and R2 are opposite from one another, but their relative speeds may be altered depending upon downhole conditions and preferences. The counter-rotation of the drill bit 56 with the reamer 58 defeats much of the torque steer that otherwise would tend to drive a drilling assembly off a particular course.

Optionally, the vertical drilling apparatus 50 may include an active directional drilling adjustment system to further assist in maintaining a true vertical path. Internal sensors (not shown) may be used to determine if (and by how much) the vertical drilling apparatus 50 is deviating from vertical. Data from the sensors could then be processed (either downhole or at the surface) and used to activate kick pads to keep the drilling apparatus 50 on track. Such measurement sensors can include, but are not limited to gravity pendulums, accelerometer sensors, gyroscope sensors, and magnetometer sensors.

Figure 5:
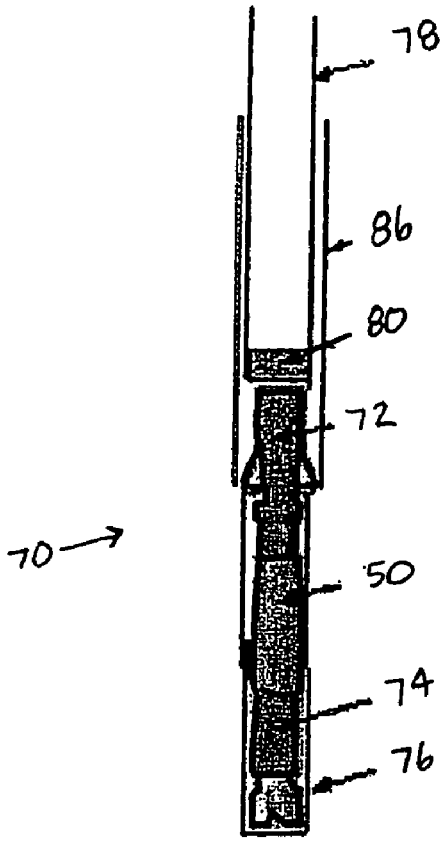
FIG. 5 shows a another embodiment of the vertical drilling system of the present invention.
Figure 6:
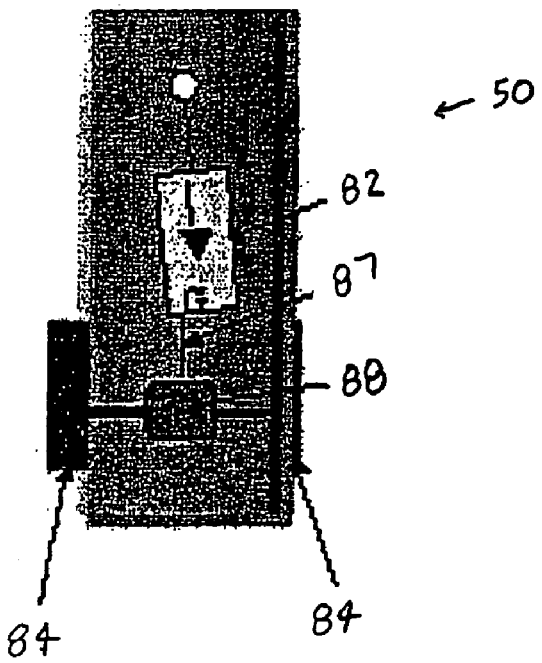
FIG. 6 shows an enlarged view of an embodiment of the vertical drilling tool of the present invention.

One such optional embodiment of the vertical drilling apparatus 50 is shown in FIGS. 5 and 6. The BHA 70 comprising the vertical drilling apparatus 50 further comprises an underreamer 72, a positive displacement motor (PDM) 74, and a drill bit 76. The BHA 70 is coupled to the casing string 78 by a casing latch 80. The casing latch 80 provides rotational and axial coupling of the BHA 70 to the casing string 78.

In this embodiment, the vertical drilling apparatus 50 comprises a weight pendulum device 82 that is coupled to a system that directs one or more pads 84 in the BHA 70 to apply lateral forces so as to maintain a vertical trajectory of the borehole 86. In the embodiment shown, the pendulum device 82 is in communication, through communication line 87, with a mud flow control valve 88 that is adapted to direct flow to the pad 84 opposite the direction of movement of the pendulum 82. The directed flow activates the pad 84 to push the vertical drilling apparatus 50 and the BHA 70 back towards the vertical direction. The magnitude of the deviation of the pendulum device 82 is compensated by a corresponding magnitude of the force provided by the pad 84 by the variable flow geometry of the mud flow control valve 88.

Depending upon the sensitivity of the pendulum 82 to certain drilling motions and vibrations, it may be advantageous to utilize a PDM 74 in order to limit these effects on the vertical drilling apparatus 50. Further control of the pendulum 82 against unwanted dynamic effects of the drilling motion can be provided by fluid damping of the pendulum 82 with oil pressure compensation along with chokes or restrictions in the fluid control valve 88.

Additional embodiments of the vertical drilling apparatus 50 can use direct mechanical linkages with the pendulum 82 to actuate the pads 84. Additionally, the pads can be actuated by electro-mechanical or electro-hydraulic means.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus to install a casing string into a borehole while it is being drilled, the casing having an internal diameter and an external diameter, the apparatus comprising:

a casing latch installed at a distal end of the casing string, the casing latch having a pass-through diameter smaller than the casing internal diameter, the casing latch configured to releaseably connect to a flexible drill collar assembly;

the flexible drill collar assembly having an enlargement tool and an articulated joint, the articulated joint adapted to position the enlargement tool in a first position that is in axial alignment with the axis of rotation of the casing string and a second position that is eccentric with respect to the axis of rotation of the casing string; and a drill bit coupled to the enlargement tool such that when the enlargement tool is in its second, eccentric, position, the drill bit drills a borehole large enough to provide clearance for the casing string and when the drill bit is in its first, axial, position, the drill bit is removable through the casing string.

2. The apparatus of claim 1, wherein the articulated joint is lockable.

3. The apparatus of claim 2, wherein the articulated joint is locked in position by sliding cams, eccentric tracks with cam followers, or j-slot mechanisms.

4. The apparatus of claim 1, wherein the articulated joint is positioned by fluid flow or weight actuation.

5. A method of casing while drilling without the use of an underreamer, the method comprising:

providing a flexible drill collar assembly coupled to the casing string and having an enlargement tool affixed to a drill bit and positionable axially and eccentrically with respect to the axis of rotation of the casing string; and positioning the enlargement tool eccentrically such that the affixed drill bit drills a borehole large enough for passage of the casing string therethrough.

6. The method of claim 5, further comprising:

retrieving the flexible collar assembly through the casing string by positioning the enlargement tool axially and removing therethrough the casing string.

7. An apparatus to install a casing string into a borehole while it is being drilled, the casing having an internal diameter and an external diameter, the apparatus comprising:

a casing latch installed at a distal end of the casing string, the casing latch having a pass-through diameter smaller than the casing internal diameter, the casing latch configured to releaseably connect to a vertical drilling assembly;

the vertical drilling assembly including a mud motor, a first cutter device, and a second cutter device, the mud motor configured to rotate the first cutter device in a direction opposite any rotation of the casing string, the second cutter device configured to rotate with the rotation of the casing string, the vertical drilling assembly configured to be retrieved through the pass-through diameter of the casing latch.

8. The apparatus of claim 7 wherein the second cutter device is configured to drill the borehole at a gauge diameter; wherein the gauge diameter is larger than an outer diameter of the casing string.

9. The apparatus of claim 7 wherein the second cutter device is an underreamer.

10. The apparatus of claim 9 wherein the underreamer is a collapsible.

11. The apparatus of claim 7 wherein the mud motor is a positive displacement mud motor.

12. The apparatus of claim 7 wherein the mud motor is a turbine-driven mud motor.

13. The apparatus of claim 7 wherein the vertical drilling assembly further includes directional measurement equipment.

14. The apparatus of claim 7 wherein the directional measurement equipment includes a measurement while drilling tool.

15. The apparatus of claim 13 wherein the directional measurement equipment includes a gyroscope.

16. The apparatus of claim 13 wherein the directional measurement equipment includes accelerometers.

17. The apparatus of claim 13 wherein the directional measurements equipment includes a gravity pendulum.

18. The apparatus of claim 13 wherein the vertical drilling assembly includes at least one kick pad to correct any deviations in the borehole detected by the directional measurement equipment.

19. The apparatus of claim 7 wherein the first cutter device is a standard drill bit located on a central axis of the vertical drilling assembly.

20. The apparatus of claim 19 wherein the second cutter device is a located on a peripheral surface of the vertical drilling assembly.

21. An apparatus to install a casing string into a borehole while it is being drilled, the casing having an internal diameter and an external diameter, the apparatus comprising:

a casing latch installed at a distal end of the casing string, the casing latch having a pass-through diameter smaller than the casing internal diameter, the casing latch configured to releaseably connect to a vertical drilling assembly;

the vertical drilling assembly including directional measurement equipment and at least one actuator, the directional measurement equipment configured to determine any deviations of the borehole from true vertical, the actuator configured to directionally bias the vertical drilling assembly in response to reports from the directional measurement equipment, the vertical drilling assembly configured to be retrieved through the pass-through diameter of the casing latch.

22. The apparatus of claim 21 wherein the directional measurement equipment includes a gyroscope.

23. The apparatus of claim 21 wherein the directional measurement equipment includes accelerometers.

24. The apparatus of claim 21 wherein the directional measurements equipment includes a gravity pendulum.

* * * * *